US009033183B2

(12) United States Patent
Hug

(10) Patent No.: US 9,033,183 B2
(45) Date of Patent: May 19, 2015

(54) EXTENSION FRAME FOR A TRANSPORT BOX OR A PALLET

(75) Inventor: Yves Hug, Oberwil-Lieli (CH)

(73) Assignee: GEORG UTZ HOLDING AG, Bremgarten (CH)

( * ) Notice: Subject to any disclaimer, the term of this patent is extended or adjusted under 35 U.S.C. 154(b) by 379 days.

(21) Appl. No.: 13/422,121

(22) Filed: Mar. 16, 2012

(65) Prior Publication Data

US 2012/0234844 A1 Sep. 20, 2012

(30) Foreign Application Priority Data

Mar. 16, 2011 (CH) ..... 0441/11

(51) Int. Cl.

| | |
|---|---|
| ***A47G 19/22*** | (2006.01) |
| ***B65D 19/18*** | (2006.01) |
| ***B65D 6/18*** | (2006.01) |

(52) U.S. Cl.

CPC ..... *B65D 19/18* (2013.01); *B65D 11/1853* (2013.01); *B65D 2519/00174* (2013.01); *B65D 2519/00422* (2013.01); *B65D 2519/00497* (2013.01); *B65D 2519/00502* (2013.01); *B65D 2519/00592* (2013.01); *B65D 2519/00641* (2013.01); *B65D 2519/00915* (2013.01)

(58) Field of Classification Search

CPC ..... B65D 19/18; B65D 11/1853; B65D 2519/00592

USPC ..... 220/1.5, 4.28, 4.29, 6, 7, 720; 108/55.1

See application file for complete search history.

(56) References Cited

U.S. PATENT DOCUMENTS

| | | | | |
|---|---|---|---|---|
| 1,164,755 | A * | 12/1915 | Rouse | 220/6 |
| 3,133,511 | A * | 5/1964 | Phillips | 108/55.1 |
| 4,235,345 | A | 11/1980 | VandeDrink et al. | |
| 4,834,254 | A | 5/1989 | Mead | |
| 6,041,931 | A | 3/2000 | Jacques | |
| 7,416,092 | B2 | 8/2008 | Dubois et al. | |
| 2011/0174809 | A1 | 7/2011 | Dubois et al. | |
| 2012/0006834 | A1 | 1/2012 | Dubois et al. | |

FOREIGN PATENT DOCUMENTS

| | | | |
|---|---|---|---|
| DE | 41 43 023 | C1 | 5/1993 |
| DE | 44 15 638 | A1 | 11/1995 |
| EP | 0 075 655 | A1 | 4/1983 |
| EP | 0 404 520 | A1 | 12/1990 |
| EP | 1 473 240 | B1 | 1/2006 |

* cited by examiner

*Primary Examiner* — Fenn Mathew
*Assistant Examiner* — Elizabeth Volz
(74) *Attorney, Agent, or Firm* — Henry M. Feiereisen LLC

(57) ABSTRACT

An extension frame for a transport box or a pallet includes two long sides, and two collapsible transverse sides. An angle piece is formed on one of the transverse sides or on one of the long sides, with the angle piece having a free end forming a hinge with a free end of an adjacent long side or transverse side. The hinge has in the open state and the collapsed state a locking position in which the long side and the adjacent transverse side are engageable.

10 Claims, 4 Drawing Sheets

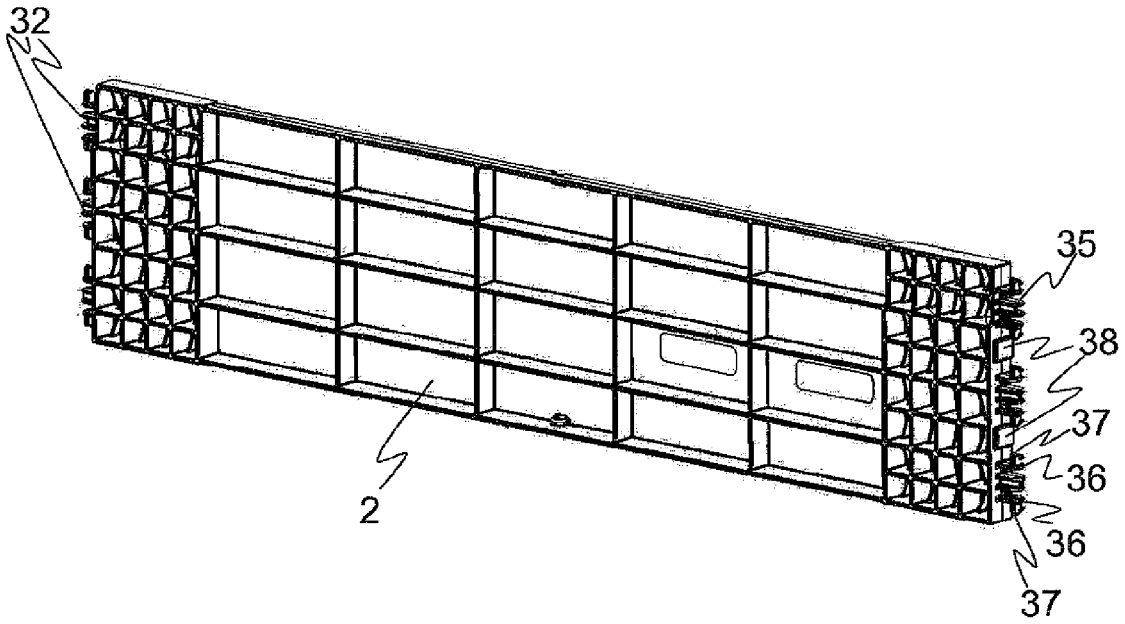
Fig. 5
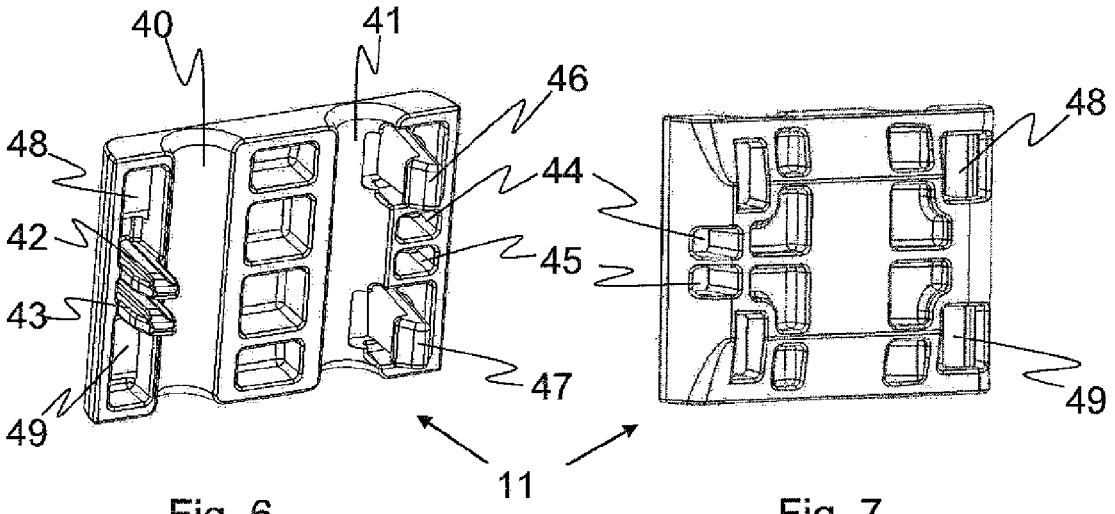
Fig. 6
Fig. 7

EXTENSION FRAME FOR A TRANSPORT BOX OR A PALLET

CROSS-REFERENCES TO RELATED APPLICATIONS

This application claims the priority of Swiss Patent Application, Serial No. 00441/11, filed Mar. 16, 2011, pursuant to 35 U.S.C. 119(a)-(d), the content of which is incorporated herein by reference in its entirety as if fully set forth herein.

BACKGROUND OF THE INVENTION

The present invention relates to an extension frame for a transport box or a pallet.

The following discussion of related art is provided to assist the reader in understanding the advantages of the invention, and is not to be construed as an admission that this related art is prior art to this invention.

Transport boxes of plastic with pallet bases have been used for the transport of large workpieces. Examples of such transport boxes are disclosed in a brochure by Georg Utz AG, 5620 Bremgarten, Switzerland. US 2004/0200833 discloses a transport box which can be stacked and collapsed. To prevent the sidewalls of such transport boxes from twisting, it is desired to distribute the load evenly upon the corner regions. For that purpose, the corner regions are provided with tubular support pillars to stabilize the shape of the transport box. Transport boxes can be increased in height through use of an extension frame to enlarge the load volume. The extension frame includes two opposite long sides and split transverse sides arranged between the long sides and collapsible. Conventional extension frames may bulge when mounted onto a transport box, thereby adversely affecting the overall stability. In addition, even though conventional extension frames are collapsible, their own weight may cause the extension frames to spontaneously open up again. This is very inconvenient when loading or unloading the frame.

It would therefore be desirable and advantageous to provide an improved extension frame to obviate prior art shortcomings.

SUMMARY OF THE INVENTION

According to one aspect of the present invention, an extension frame for a transport box or a pallet includes two long sides, two collapsible transverse sides, an angle piece formed on one of the transverse sides or on one of the long sides, with the angle piece having a free end forming a hinge with a free end of an adjacent one of the long side or transverse side, wherein the hinge has in each of an open state and a collapsed state a locking position in which the long side and the adjacent transverse side are engageable.

An extension frame configured in accordance with the present invention has the advantage of being very stable in shape when assuming the open state as well as the collapsible state. The extension frame is as rigid and stable as the transport box forming the base or as a respective pallet. Thus, the extension frame can be mounted to a transport box for increasing the loading volume while still maintaining precise dimensions at the upper rim. As a result, same lids can be used as those for conventional transport boxes. A pallet equipped with such an extension frame can be used as shallow container for smaller workpieces.

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 5 is a perspective view of a long side of the extension frame as viewed from outside;

FIG. 6 is a perspective view of a connection piece as part of a double-jointed hinge, as viewed from inside;

FIG. 7 is a perspective view of the connection piece from outside;

DETAILED DESCRIPTION OF PREFERRED EMBODIMENTS

Figure 1:
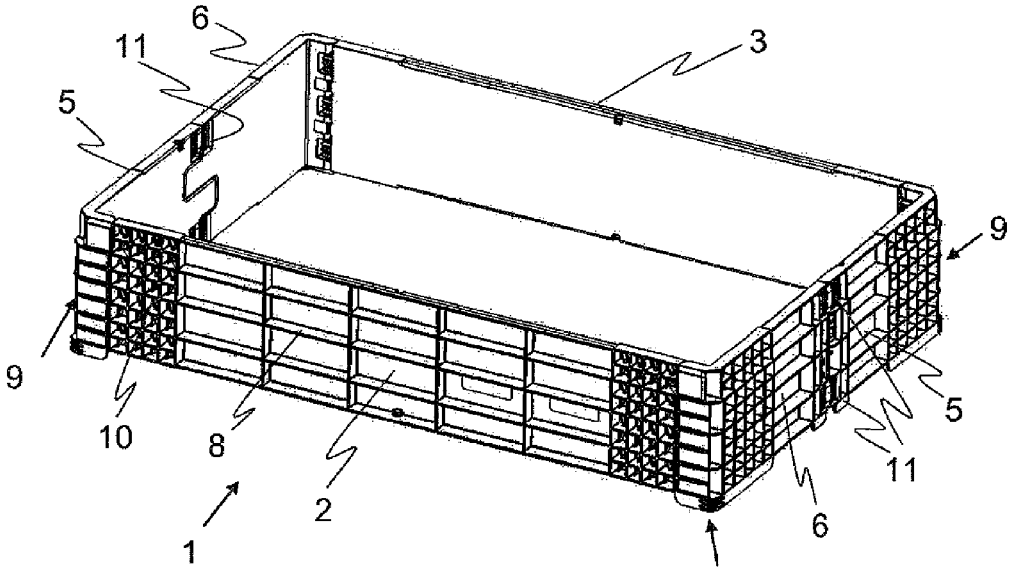
FIG. 1 is a top and side perspective view of an extension frame according to the present invention in an open state.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a top and side perspective view of an extension frame according to the present invention, generally designated by reference numeral 1 in an open state. The extension frame 1 includes two opposite long sides 2, 3 which are connected by a transverse side 5 on a right-hand side, as viewed in the drawing plane, and by a transverse side 6 on the left-hand side. The long sides 2, 3 and the transverse sides 5, 6 are provided with longitudinal and transversal ribs 8 in a rough pattern and with longitudinal and transversal ribs 10 in corner regions 9 in a tight pattern. Connection pieces 11 are provided on the inside and outside between the transverse sides 5, 6 and fastened to one another to form a double-jointed hinge.

Figure 2:
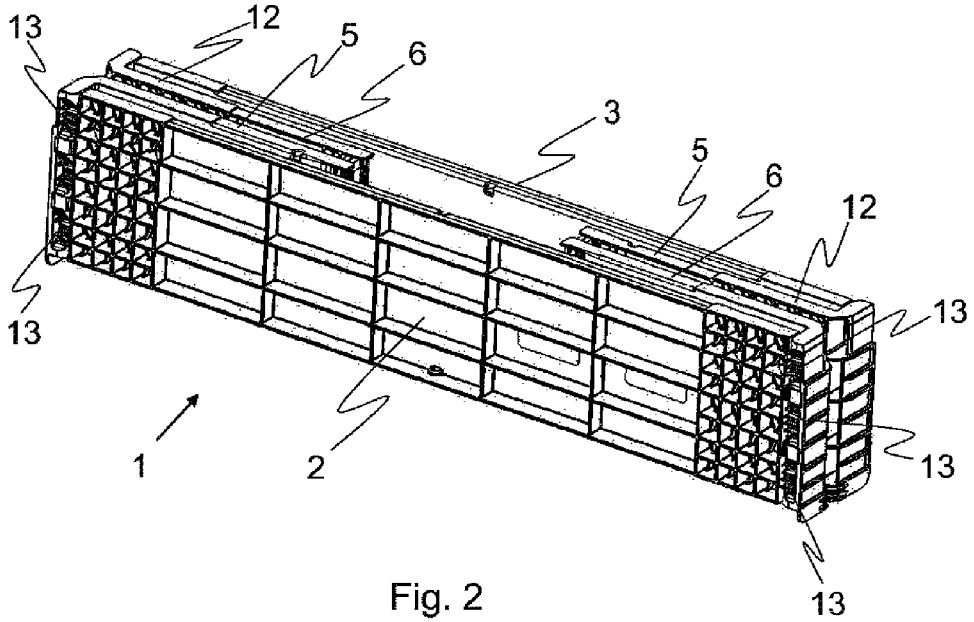
FIG. 2 is a top and side perspective view of the extension frame in a collapsed state.

FIG. 2 shows the extension frame 1 in collapsed state, and it can be seen that each of the transverse sides 5, 6 has an angle piece which forms together with the face end of the long sides 2, 3 three hinges 13 lying on top of one another in direction of a hinge axis A.

Figure 3:
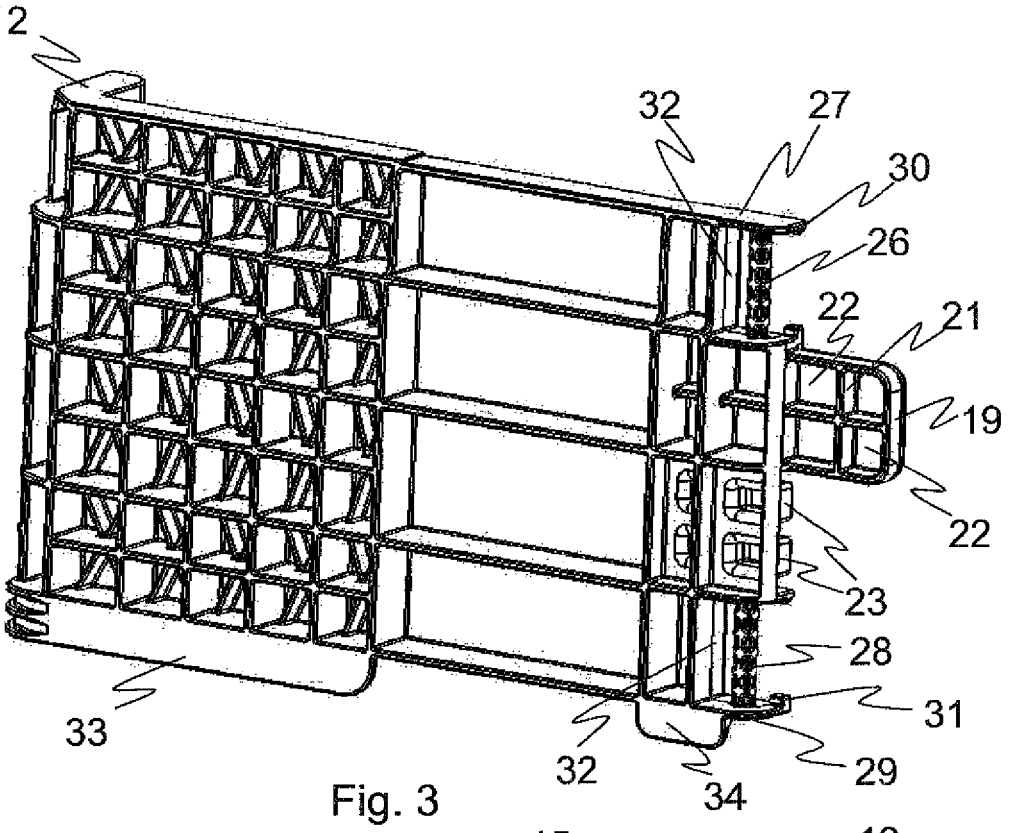
FIG. 3 is a perspective view of a left transverse side of the extension frame as viewed from outside.
Figure 4:
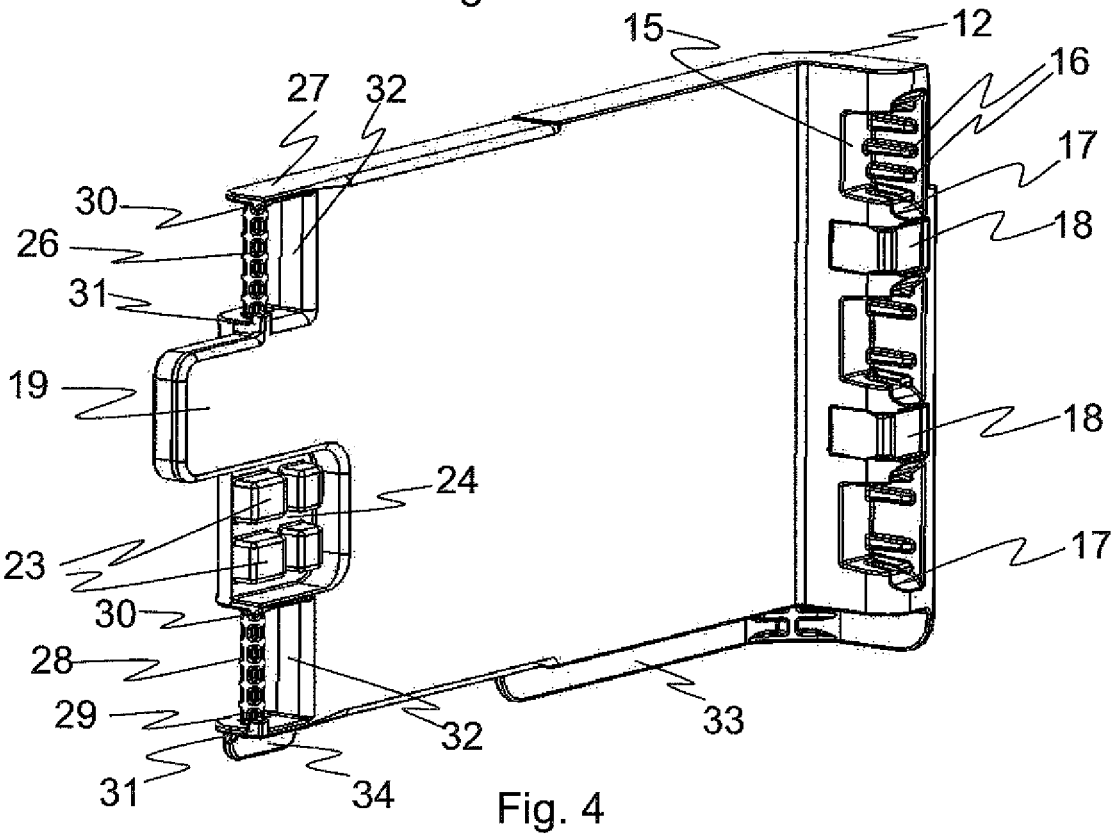
FIG. 4 is a perspective view of the left transverse side of the extension frame as viewed from inside.

FIGS. 3 and 4 show only the left-hand transverse side 6 from outside and inside, respectively. Rectangular recesses 15 are cut out at the free end of the angle piece 12 and are provided with guide ribs 16 and bores 17. Formed between adjacent recesses 15 is an angular rectangular flat groove 18, with the angle coinciding with the edge of the angle piece 12. Formed on the other end of the transverse side 6 is a protruding tongue 19 which has four indentations 22 separated by a cross-shaped web 21. Arranged adjacent to the tongue 19 are four protrusions 23 which are separated from one another by a cross-shaped groove 24. A pin 26 is provided above the tongue 19 between an upper projection 27 on the transverse side 6 and the tongue 19 and extends in parallel relation to the short side of the transverse side 6. A pin 28 is provided below the protrusions 23 between a lower projection 29 and the protrusions 23 and also extends parallel relation to the short side of the transverse side 6. A small, slightly beveled protrusion 30 is flush-mounted at the projection 27 on the inner side, and a small, cuboid protrusion 31 is flush-mounted at the projection 29 on the inner side. A same cubic protrusion 31 is also provided above the tongue 19 and a same beveled protrusion 30 is provided below the protrusion 23. The protrusions 30, 31 extend in parallel alignment to the short side of the transverse side 6. Beveled stops 32 are provided to the side of the two pins 26, 28—in FIG. 3 on the left-hand side and in FIG. 4 on the right-hand side.

A wide angular stop 33 is further provided on the angle piece 12, and a stop 34 is provided at the other end of the transverse side 6.

FIG. 5 shows the long side 2 with three hinge parts 35 at each of the two short sides. The hinge parts 35 are comprised of three parallel flat pins 36, with the two outer ones of the flat pins 36 having each a circular cylindrical protrusion 37 for engagement in the bores 17 of the transverse sides 5, 6, shown in FIGS. 3 and 4. Provided between the hinge parts 35 are slightly shallow block-shaped elevations 38 which interact with the angular grooves 18 of the transverse sides 5, 6 to establish a locking position in the open state and a locking position in the collapsed state.

FIGS. 6 and 7 show the connection piece 11 from inside and outside, respectively. The connection piece 11 includes two parallel semicircular cylindrical grooves 40, 41, two pins 42, 43 protruding in parallel relation, and two complementary openings 44, 45. Further provided are two barbs 46, 47 for hooked engagement in two complementary openings 48, 49 on both sides of the pins 42, 43. Thus, two identical connection pieces 11 can be joined together by locking the barbs 46, 47 in the openings 48, 49 to thereby embrace the pairs of pins 26, 28 of the transverse sides 5, 6 and form the double-jointed hinge.

Figure 8:
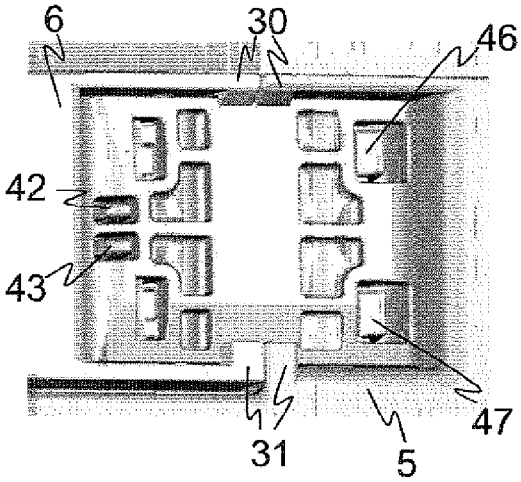
FIG. 8 is a cutaway view of a detail of the open extension frame in an area of the connection piece.
Figure 9:
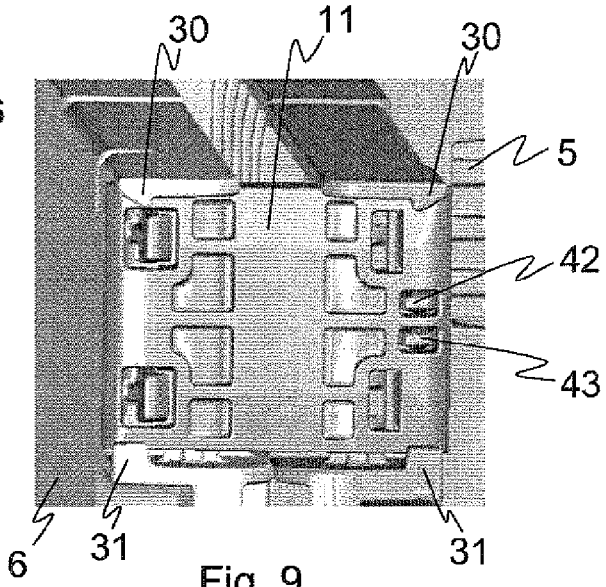
FIG. 9 is a perspective view of the detail in the area of the connection piece in collapsed state of the extension frame.

FIG. 8 shows the double-jointed hinge with the connection piece 11 in open state from the inner side of the extension frame 1, with both the upper portion of the left transverse side 6 and the upper portion of the right transverse side 5 being partly illustrated, both with the beveled protrusions 30 and the cuboid protrusions 31. The protrusions 30, 31 form together a further locking position in the open state of the extension frame 1. FIG. 9 shows the double-jointed hinge with the connection piece 11 in the collapsed state. The protrusions 30, 31 are now positioned at the outer boundary of the connection piece 11 and urge the opposite angle piece 11 (not visible in FIG. 9) against the stops 32 so as to establish another locking position and thereby prevent the transverse sides 5, 6 from spontaneously opening up.

Figure 10:
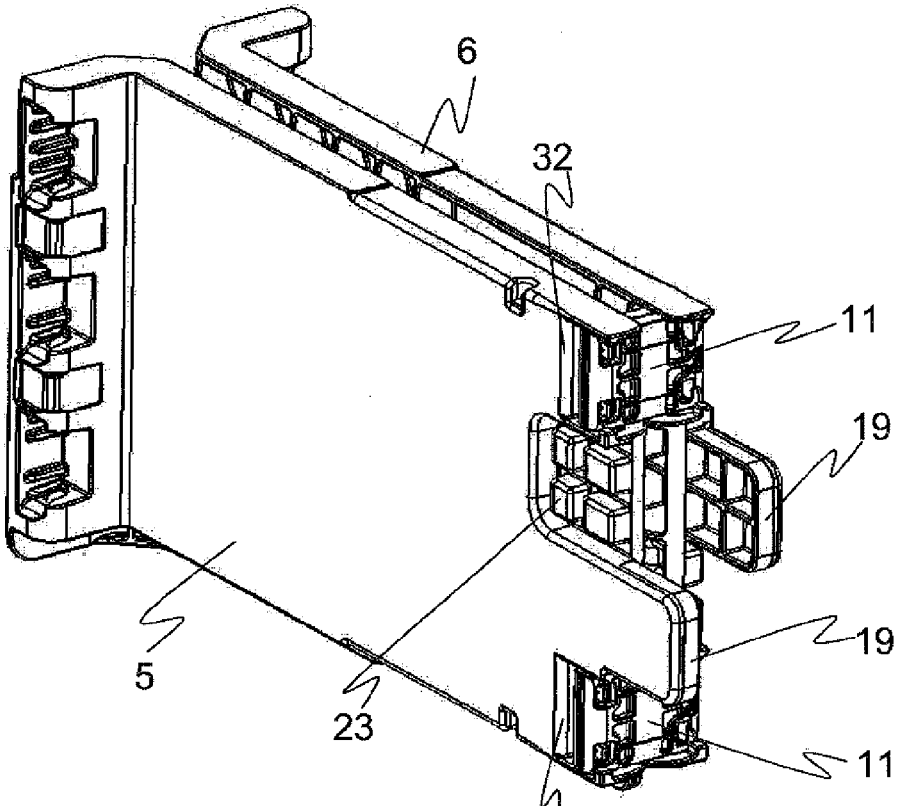
FIG. 10 is a perspective view of the left and right transverse sides of the extension frame in a collapsed state.

FIG. 10 shows both transverse sides 5, 6 in the collapsed state, with the locking positions of the upper double-jointed hinge and the lower double-jointed hinge being visible. When the transverse sides 5, 6 are folded open, as shown in FIG. 1, FIG. 10 clearly shows that the tongue 19 with its cross-shaped web 21 is clamped against the protrusions 23. As such a clamped connection is also established on the opposite side between the tongue 19 and the protrusions 23, a very stable union is realized which rigidly extends the walls of the subjacent transport box so that no bulging is encountered in the upper region.

The various components of the afore-described extension frame 1 are made of an appropriate thermoplastic material, such as, e.g., ABS or PE through injection molding.

It will be understood by persons skilled in the art that the afore-described extension frame 1 is applicable not only for a transport box but equally applicable for a pallet of plastic. Thus, a relatively shallow transport container with rigid walls can, optionally, be realized for storing smaller workpieces.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. An extension frame of thermoplastic material for enlarging a load volume of a transport box or for equipping a pallet to form a container, comprising:

two long sides;

two collapsible transverse sides;

hinges with a hinge axis provided between the long sides and the transverse sides;

an angle piece integrally formed on one of the transverse sides or on one of the long sides and having a free end, each hinge is formed by the free end of the angle piece and a free end of an adjacent one of the long side or transverse side, said free end of the angle piece and said free end of an adjacent one of the long or transverse side forming locking elements at the hinge axis, such that each hinge having in each of an open state and a collapsed state a locking position in which the long side and the adjacent transverse side are engageable.

2. The extension frame of claim 1, wherein the locking elements are formed by a slightly protruding elevation on one side of the transverse side or long side and an angular groove on another side of the long side or transverse side.

3. The extension frame of claim 1, further comprising at least one protrusion provided adjacent to each of the tongues, each said tongue having on the adjacent transverse side at least one indentation which complements the protrusion.

4. The extension frame of claim 1, wherein the transverse sides have projecting stops for aligning the extension frame to an edge of the transport box or pallet.

5. The extension frame of claim 1, wherein each of adjacent transverse sides are provided at their end opposite to the hinge with a protruding tongue, with the tongue of one of the transverse sides and the tongue of the other one of the transverse sides arranged in superimposed disposition so that the tongues of the adjacent transverse sides interlock one another in a stretched state.

6. The extension frame of claim 5, wherein the hinge is configured double-jointed between the transverse sides.

7. The extension frame of claim 6, wherein the double-jointed hinge is formed by pins arranged in parallel relation to a short edge of the transverse side and a connection piece in surrounding relation to the pins of the adjacent transverse sides.

8. The extension frame of claim 7, wherein the connection piece is formed by two half-shells, each half-shell provided with two semicircular cylindrical grooves, with the half-shells being connectable with one another by snap elements.

9. The extension frame of claim 5, wherein the transverse sides have in each of the collapsed and stretched states a locking position in the area of the tongue for engagement of adjacent transverse sides.

10. The extension frame of claim 9, wherein the locking positions are formed by abutting rectangular protrusions on the transverse sides.

* * * * *